US007562415B2

(12) United States Patent
Moon

(10) Patent No.: US 7,562,415 B2
(45) Date of Patent: Jul. 21, 2009

(54) DRIVING CONTROL APPARATUS OF ROTARY BRUSH FOR USE IN VACUUM CLEANER

(75) Inventor: Joo-Sung Moon, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 249 days.

(21) Appl. No.: 11/704,587

(22) Filed: Feb. 9, 2007

(65) Prior Publication Data

US 2008/0066258 A1 Mar. 20, 2008

(30) Foreign Application Priority Data

Sep. 14, 2006 (KR) ..... 10-2006-0088917

(51) Int. Cl.
*A47L 5/30* (2006.01)

(52) U.S. Cl. ..... 15/389; 15/390

(58) Field of Classification Search ..... 15/389, 15/390; *A47L 5/30*
See application file for complete search history.

(56) References Cited

U.S. PATENT DOCUMENTS 6,098,243 A 8/2000 Kim ..... 15/390
7,107,647 B2 9/2006 Park ..... 15/390

FOREIGN PATENT DOCUMENTS

| | | |
|---|---|---|
| GB | 2336294 A | 10/1999 |
| GB | 2389779 A | 12/2003 |
| KR | 990081796 | 11/1999 |

OTHER PUBLICATIONS

Official Action dated Apr. 20, 2007 from the British Patent Office in correspnding to Patent Application No. 0703071.1.

*Primary Examiner*—David A Redding
(74) *Attorney, Agent, or Firm*—Ohlandt, Greeley, Ruggiero & Perle, L.L.P.

(57) ABSTRACT

A driving control apparatus of a rotary brush, which controls a drive of the rotary brush disposed in a suction body of a vacuum cleaner, is disclosed. The driving control apparatus includes a fixing bracket disposed in a suction body of a vacuum cleaner, a link unit pivotably connected to the fixing bracket, a pedal unit connected to one side of the link unit, and a pulley unit to move in combination with the link unit and to connect or separate a driving belt to or from a driving shaft, and the pulley unit is rotated in the same direction as a rotating direction of the driving belt when coming in contact with the driving belt.

6 Claims, 6 Drawing Sheets

DRIVING CONTROL APPARATUS OF ROTARY BRUSH FOR USE IN VACUUM CLEANER

CROSS-REFERENCE TO RELATED APPLICATIONS

This application claims the benefit under 35 U.S.C. § 119 (a) of Korean Patent Application No. 2006-0088917, filed on Sep. 14, 2006, in the Korean Intellectual Property Office, the entire disclosure of which is incorporated herein by reference.

BACKGROUND OF THE INVENTION

1. Field of the Invention

The present disclosure relates to a driving control apparatus of a rotary brush, and more particularly, to a driving control apparatus of a rotary brush, which controls a drive of the rotary brush installed in a suction body of a vacuum cleaner.

2. Description of the Related Art

As disclosed in Korean patent No. 279,667, a conventional driving control apparatus of a rotary brush is configured, so that the rotary brush rotated by receiving a driving force from a motor driving shaft through a driving belt, one side of which is connected to the motor driving shaft and the other side of which is connected to one side of the rotary brush. To stop the rotation of the rotary brush, a user operates a belt extending rack to pull a portion of the driving belt and, thus, to extend the driving belt in a length larger than a distance between the rotary brush and the motor driving shaft. The belt extending rack is disposed adjacent to the driving belt to pivoted by a predetermined angle in one direction or a direction reverse thereto. As the belt extending rack pulls and extends the driving belt, the driving belt is separated from the motor driving shaft to block a driving force from being transmitted to the rotary brush. In this case, the driving belt is formed of a material, such as a rubber, a synthetic rubber or the like, so that it has a predetermined elastic force capable of being extended and restored in the range of a predetermined length.

However, according to the conventional driving control apparatus of the rotary brush as described above, the driving belt at the one side thereof is wound on the motor driving shaft to rotate in a high speed, whereas the belt extending rack is pivotably fixed. Accordingly, to stop the rotation of the rotary brush, when the belt extending rack is pivoted to separate the driving belt from the motor driving shaft, a large friction force is instantaneously generated at contact portions between the driving belt and the belt extending rack, which form a rotating element and a fixed element, respectively. As a result, the contact portions of the driving belt and the belt extending rack generate a high temperature of heat, and thus a portion of the driving belt is damaged or in the worst case, the driving belt is cut, so that it cannot control a drive of the rotary brush.

Also, in case of blocking the driving force from being transmitted to the rotary brush, the belt extending rack is maintained in a tensed state only by a leaf spring while it extends the driving belt. If an elastic force of the leaf spring is deteriorated, the leaf spring does not overcome a tensile force of the driving belt. Thus, a problem may occur, in that it is impossible to accurately control a driving force transmitting and blocking operation to the rotary brush.

SUMMARY OF THE INVENTION

The present disclosure has been developed in order to solve the above problems in the related art. Accordingly, an aspect of the present disclosure is to provide a driving control apparatus of a rotary brush capable of preventing a damage to parts caused by a friction force generated during a driving force transmitting and blocking operation to the rotary brush.

Another aspect of the present disclosure is to provide a driving control apparatus of a rotary brush capable of more stably and accurately carrying out a driving force transmitting and blocking operation to the rotary brush.

The above aspects are achieved by providing a driving control apparatus of a rotary brush including a fixing bracket disposed in a suction body of a vacuum cleaner, a link unit pivotably connected to the fixing bracket, a pedal unit connected to one side of the link unit, and a pulley unit to move in combination with the link unit and to connect or separate a driving belt to or from a driving shaft. The pulley unit is rotated in the same direction as a rotating direction of the driving belt when coming in contact with the driving belt. Accordingly, a friction of contact parts between the pulley unit and the driving belt is reduced, so that the pulley unit or the driving belt is prevented from being damaged due to an excessive friction force between the pulley unit and the driving belt.

Here, preferably, but not necessarily, the pulley unit includes a fixed shaft fixed to the link unit, and a rotary cylinder rotatably disposed on the fixed shaft. Accordingly, the driving belt comes in contact with the rotary cylinder and the driving belt and the rotary cylinder rotate in the same direction.

Also, preferably, but not necessarily, the link unit includes at least three members to be foldable in at least two steps. With this construction, a driving force can be stably transmitted and blocked as compared with a link unit of folding in one step.

According to an exemplary embodiment of the present disclosure, the link unit may include a first arm having one side pivotably connected to the fixing bracket, a second arm having one side pivotably connected to the fixing bracket, a link having one side connected to the first arm and the other side connected to the second arm thus to move the first and the second arms in combination with each other, and a returning spring to elastically connect the link and the fixing bracket with each other.

Also, the pedal unit may be connected with the first arm. In this case, the apparatus may be configured, so that when the pedal unit is pushed and rotated in a clockwise direction, the first and the second arms are also rotated in the clockwise direction to connect the driving belt to the driving shaft, and when the pedal unit is pushed and rotated in a counterclockwise direction, the first and the second arms are also rotated in the counterclockwise direction to separate the driving belt from the driving shaft.

Also, the fixing bracket may include a first stopper projected to a position where an angle between upper parts of the first arm and the link is maintained in more than 180° thus to block and stop pivot motions of the first arm and the link, and a second stopper to control a pivot motion of the second arm, which is pivoted by an elastic force of the returning spring.

BRIEF DESCRIPTION OF THE DRAWING FIGURES

The above aspects and other advantages of the present disclosure will be more apparent by describing an embodiment of the present disclosure with reference to the accompanying drawing figures, in which.

Figure 5:
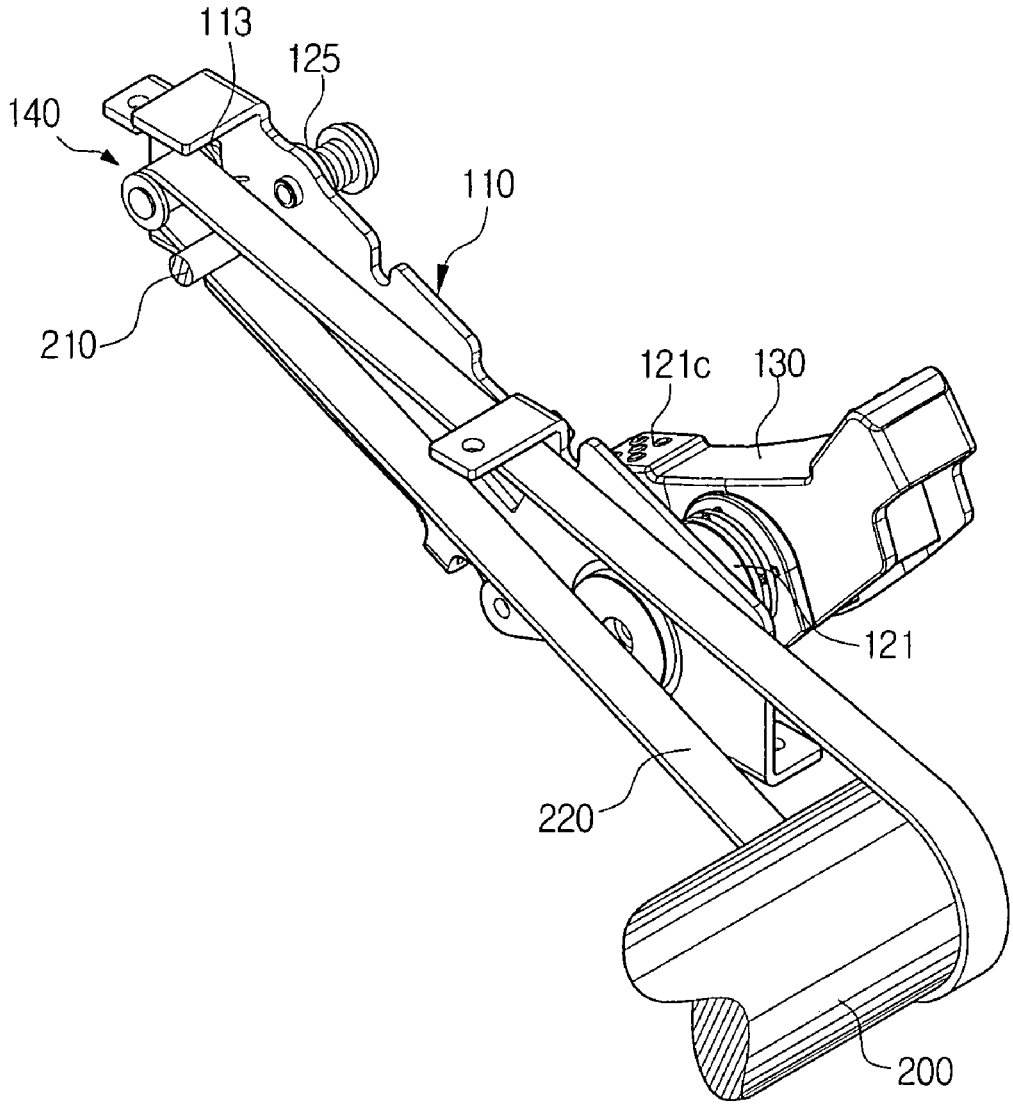
Figure 6:
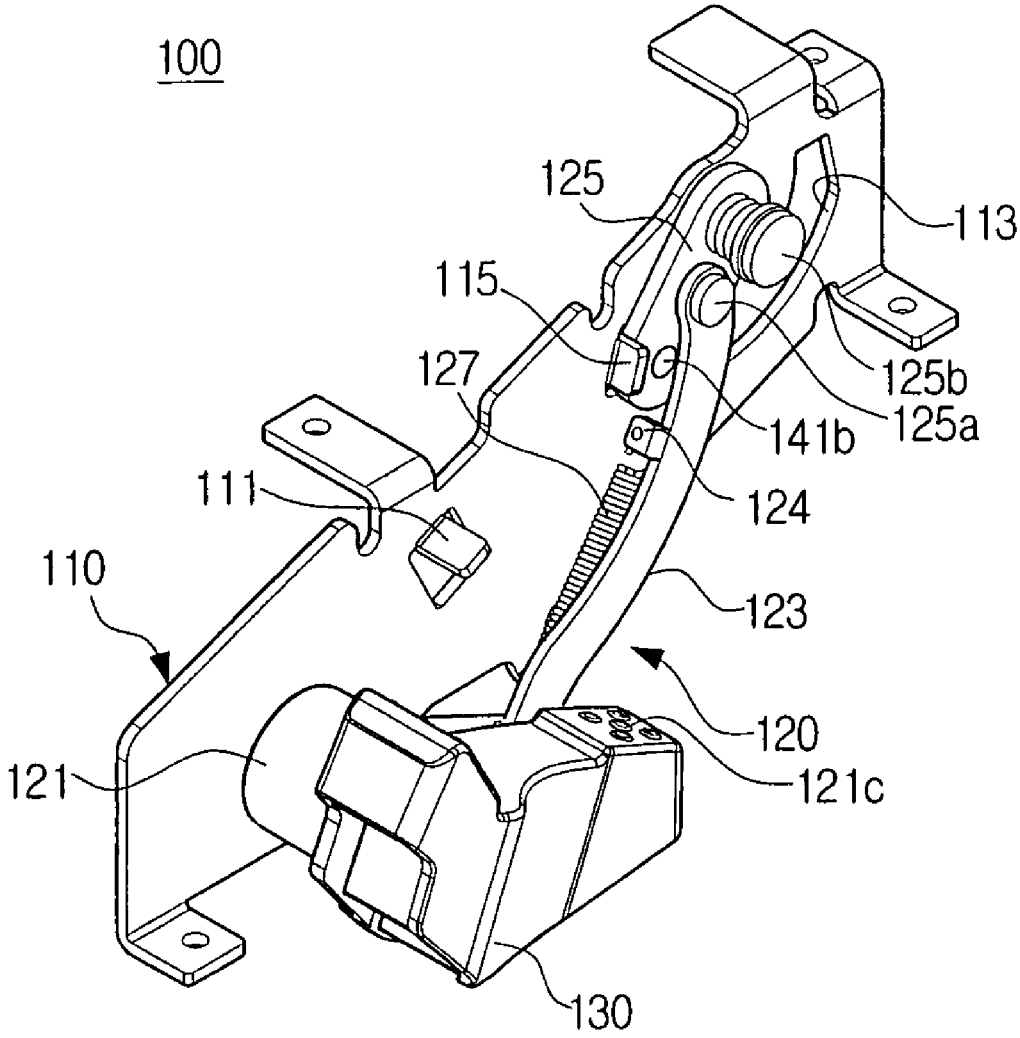
Figure 7:
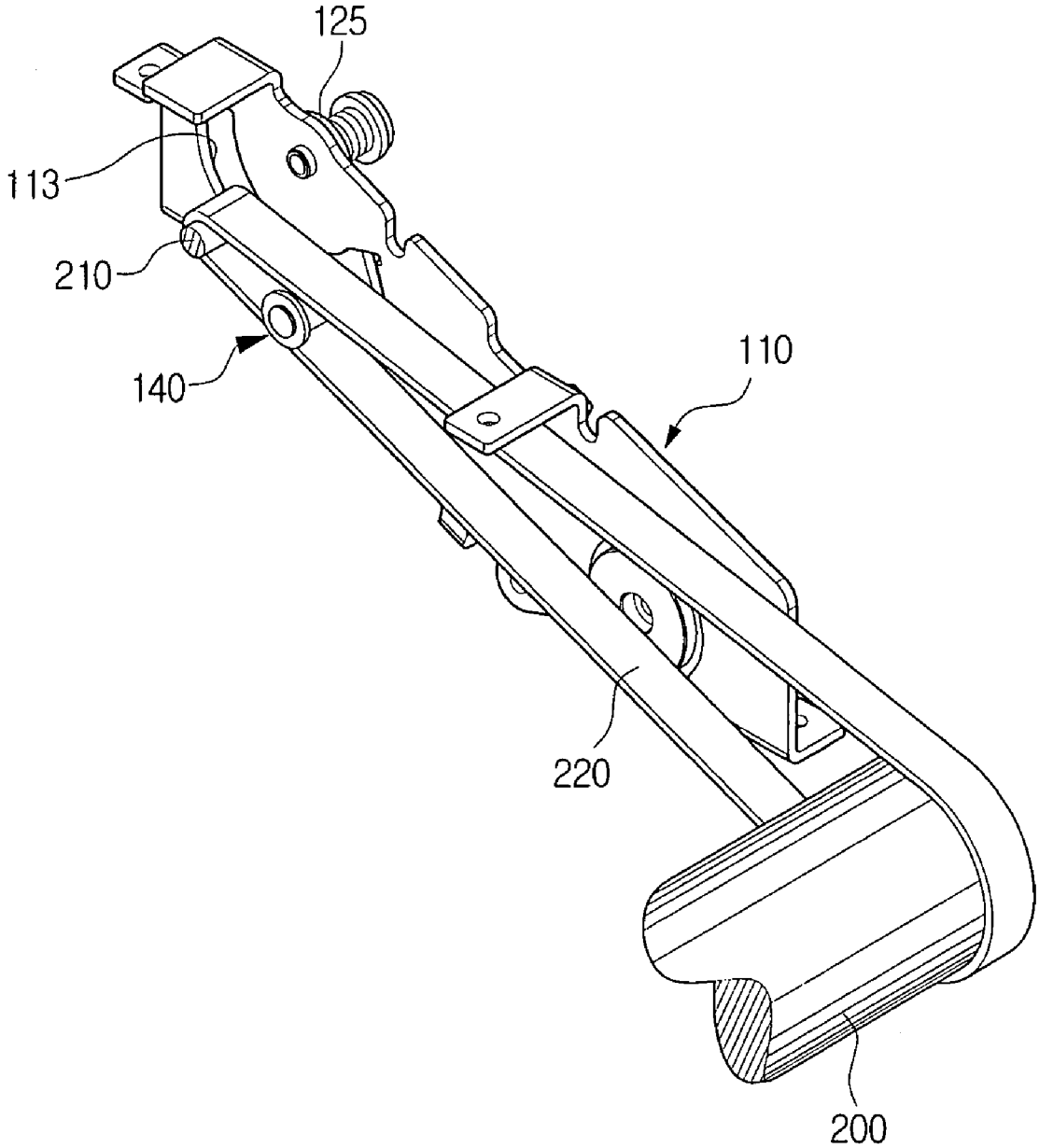

FIG. 5 is a perspective view exemplifying a state that a driving force is blocked from being transmitted to the rotary brush from a motor driving shaft by the driving control apparatus of the rotary brush; and FIGS. 6 and 7 are perspective views exemplifying a state that the driving force is transmitted to the rotary brush from the motor driving shaft by the driving control apparatus of the rotary brush.

In the drawing figures, it should be understood that like reference numerals refer to like features and structures.

DETAILED DESCRIPTION OF AN EXEMPLARY EMBODIMENT

Hereinafter, a driving control apparatus of a rotary brush according to an exemplary embodiment of the present disclosure will now be described in greater detail with reference to the accompanying drawing figures.

Figure 1:
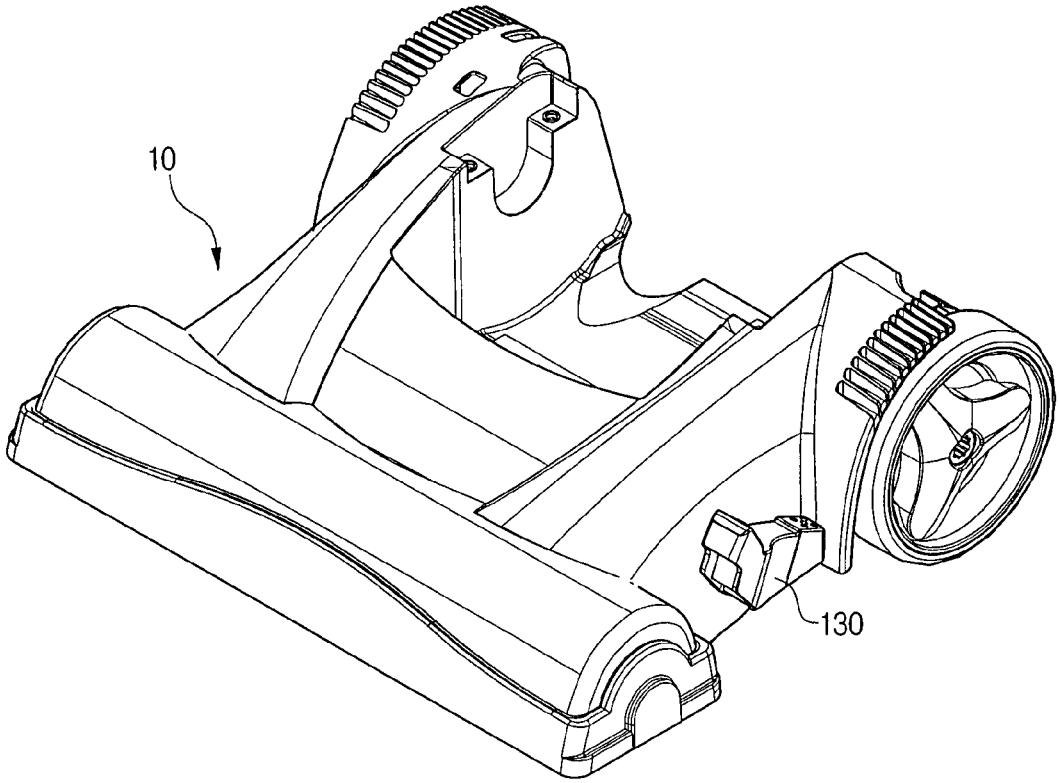
FIG. 1 is a schematic perspective view exemplifying a suction body in which a driving control apparatus of a rotary brush according to an exemplary embodiment of the present disclosure is mounted.
Figure 2:
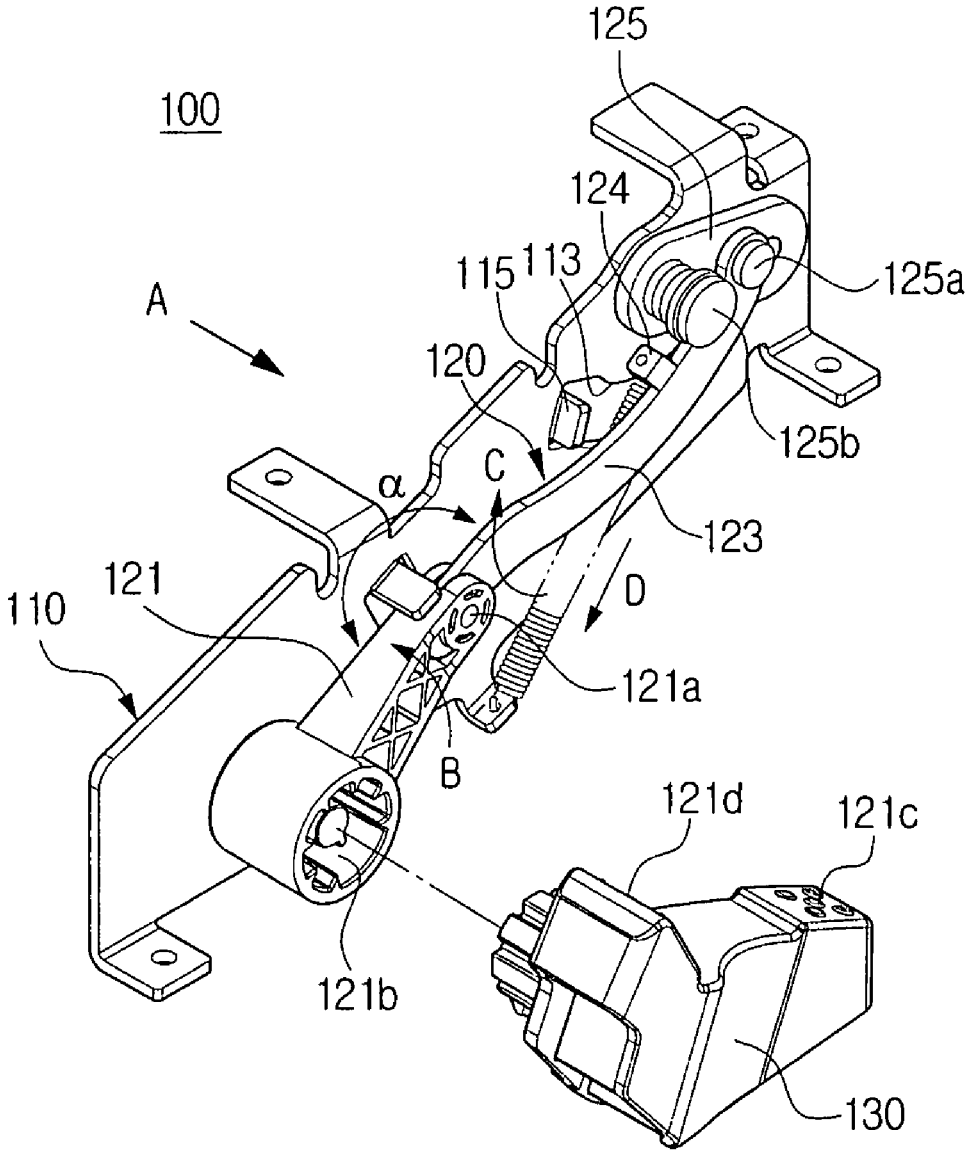
FIG. 2 is a perspective view exemplifying the driving control apparatus of the rotary brush according to the exemplary embodiment of the present disclosure.
Figure 3:
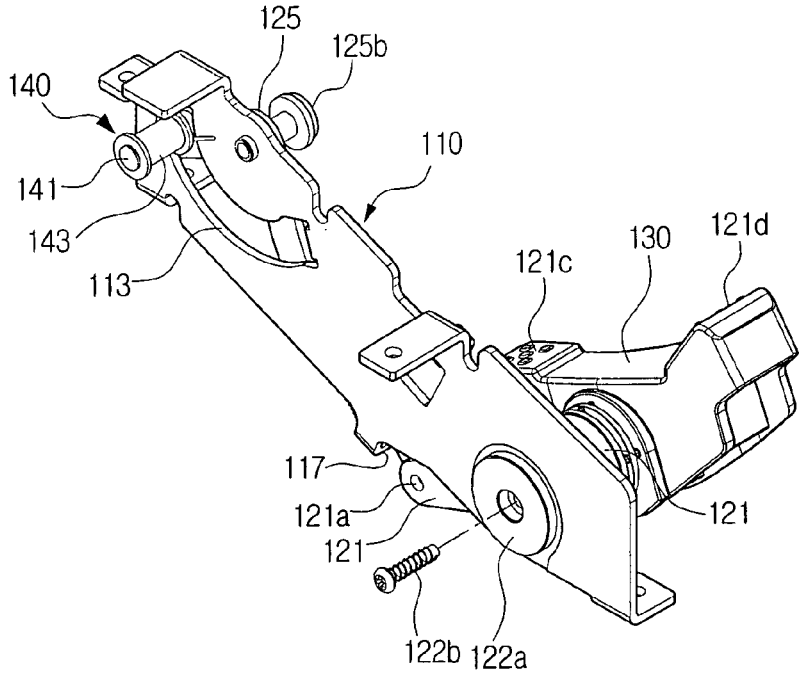
FIG. 3 is a perspective view of the driving control apparatus of the rotary brush as viewed from a direction of arrow A of FIG. 2.
Figure 4:
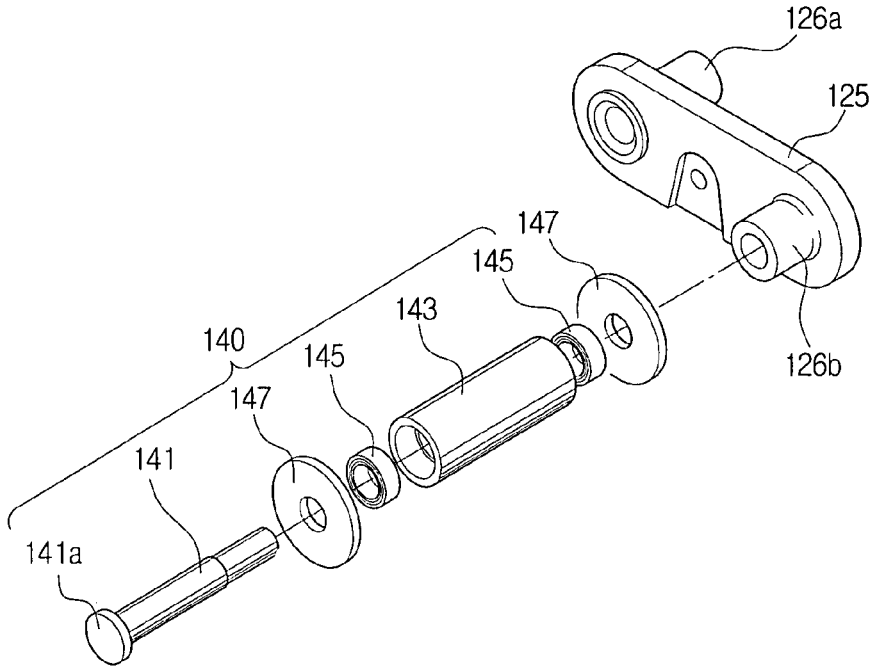
FIG. 4 is an exploded perspective view exemplifying a second arm and a pulley unit illustrated in FIG. 2.

FIG. 1 is a schematic perspective view exemplifying a suction body in which a driving control apparatus of a rotary brush according to an exemplary embodiment of the present disclosure is mounted, FIG. 2 is a perspective view exemplifying the driving control apparatus of the rotary brush, FIG. 3 is a perspective view of the driving control apparatus of the rotary brush as viewed from a direction of arrow A of FIG. 2, and FIG. 4 is an exploded perspective view exemplifying a second arm and a pulley unit illustrated in FIG. 2.

Referring to FIGS. 1 through 4, the driving control apparatus 100 of the rotary brush according to the exemplary embodiment of the present disclosure includes a fixing bracket 110, a link unit 120, a pedal unit 130, and a pulley unit 140.

The fixing bracket 110 is fixed in a suction body 10. On the fixing bracket 110 are projected and formed first and second stoppers 111 and 115 (see FIGS. 2 and 6), which controls a range of a pivot motion of the link unit 120 in a combining direction of the link unit 120. In the vicinity of the second stopper 115 is formed a U-shaped guide hole 113, which is formed to have in a predetermined curvature.

The link unit 120 is pivotably connected to one surface of the fixing bracket 110, and is configured, so that three members are rotatably connected to one another to be foldable in two steps. In the exemplary embodiment of the present disclosure, the link unit 120 includes a first arm 121, a link 123, a second arm 125 and a returning spring 127. As illustrated in FIG. 3, the first arm 121 is pivotably connected to the fixing bracket 110 by inserting a fixing screw 122*b* into a combining hole 122*a*. As illustrated in FIG. 2, the link 123 has one end pivotably connected with the first arm 121 by a first hinge pin 121*a* and the other end hinged to the second arm 125 by a second hinged pin 125*a*. Referring to FIGS. 2 and 4, the second arm 125 at one surface thereof is connected with the pulley unit 140 by one end 141*b* of fixed shaft 141 and at a combining part 126*a* projected from the other surface thereof is rotatably fixed to the fixing bracket 110 by a third hinge pin 125*b*. Accordingly, if the second arm 125 is moved along the U-shaped guide hole 113, the pulley unit 140 installed on the second arm 125 is also moved front and rear in a longitudinal direction of the fixing bracket 110 along the guide hole 113 thus to extend or contract the driving pulley 140. Referring to FIG. 6, the returning spring 127 has one end fixed to a first fixing piece 117 provided on the fixing bracket 110 and the other end fixed to a second fixing piece 124.

As illustrated in FIG. 1, the pedal unit 130 is exposed to the outside from the suction body 10, so that a user can push it by her/his foot. The pedal unit 130 is connected to a pivot center of the first arm 121, that is, in a socket part 121*b* (see FIG. 2) of the first arm 121. Accordingly, when a first foothold 121*c* of the pedal unit 130 illustrated in FIG. 2 is pushed to rotate the pedal unit 130 in a clockwise direction, the first arm 121 is also pivoted in the clockwise direction and thus the driving belt 220 is separated from a driving shaft 210 (see FIGS. 5 and 7), and when a second foothold 121*d* of the pedal unit 130 is pushed to rotate the pedal unit 130 in a counterclockwise direction, the first arm 121 is also pivoted in the counterclockwise direction and thus the driving belt 220 is connected to the driving shaft 210 to transmit a driving force to the rotary brush 200. An operation of the driving control apparatus 100 according to the exemplary embodiment of the present disclosure as described above will be described in details below.

As illustrated in FIG. 4, the pulley unit 140 includes a fixed shaft 141, a rotary cylinder 143, a pair of bearings 145, and a pair of bushes 147. The fixed shaft 141 has one end 141*b* connected to a connecting part 126*b* projected in a vertical direction from the one surface of the second arm 125 and the other end provided with a head part 141*a*. The rotary cylinder 143 is rotatably disposed on the fixed shaft 141. In a driving force blocking operation of the link unit 120, the rotary cylinder 143 comes in contact with the rotating driving belt 220 (see FIG. 5) and at the same time, rotates in a rotating direction of the driving belt 220 along therewith. The pair of bearings 145 is disposed between the fixed shaft 141 and the rotary cylinder 143. The pair of bushes is disposed at both sides of the rotary cylinder 143 to prevent the pair of beatings 145 disposed inside the rotary cylinder 143 from bolting out outside the rotary cylinder 143 and to prevent the rotary cylinder 143 from bolting from the fixed shaft 141.

Hereinafter, an operation of the driving control apparatus of the rotary brush according to the exemplary embodiment of the present disclosure constructed as described above will be described in details with reference to the accompanying drawing figures.

FIG. 5 is a perspective view exemplifying a state that a driving force is blocked from being transmitted to the rotary brush from a motor driving shaft by the driving control apparatus of the rotary brush, and FIGS. 6 and 7 are perspective views exemplifying a state that the driving force is transmitted to the rotary brush from the motor driving shaft by the driving control apparatus of the rotary brush.

At first, prior to explaining the operation of the driving control apparatus of the rotary brush according to the exemplary embodiment of the present disclosure, it assumes that as illustrated in FIGS. 2 and 5, an initial position of the pulley unit 140 is a position where the pulley unit 140 is positioned more apart from the rotary brush 200 as compared with the driving shaft 210, so that the rotary brush 200 is not driven.

To drive the rotary brush 200, when the first foothold 121*c* of the pedal unit 130 illustrated in FIG. 2 is pushed to rotate the pedal unit 130 in a clockwise direction, the first arm 121 is pivoted in the same direction as the rotating direction of the pedal unit 130 by an elastic force of the returning spring 127. According to this, as illustrated in FIG. 6, the one side of the link 123 connected with the first arm 121 is rotated in a counterclockwise direction and is lowered toward a lower part of the fixing bracket 110. Also, the other side of the link 123 connected with the second arm 125 is rotated in the counterclockwise direction to rotate the second arm 125 in the clockwise direction. That is, the second arm 125 is pivoted in the clockwise direction about the third hinge pin 125*b*, so that the pulley unit 140 fixed to the second arm 125 is moved along the U-shaped guide hole 113 to a position where it is closer to the rotary brush 200 as compared with the driving shaft 210. Accordingly, the driving belt 220 is connected to the driving shaft 210, but separated from the pulley unit 140, so that it rotates the rotary brush 200. That is, as illustrated in FIG. 7, the driving belt 220 comes in elastic contact with the rotating driving shaft 210 to transmit a driving force of the driving shaft 210 to the rotary brush 200 and thus to drive the rotary brush 200. In this case, the second arm 125 pivoted by the elastic force of the returning spring 127 is blocked and stopped by the second stopper 115, so that the pulley unit 140 is located inside the driving belt 220 at a state that it is in non-contact with the driving belt 220 (see FIG. 7).

To the contrary, in case that the driving force is blocked from being transmitted to the rotary brush 200, when the second foothold 121*d* of the pedal unit 130 illustrated in FIG. 2 is pushed to rotate the pedal unit 130 in a counterclockwise direction, the first arm 121 is pivoted in the same direction as the rotating direction of the pedal unit 130, so that the one side of the link 123 connected therewith is rotated in a clockwise direction and is moved toward an upper part of the fixing bracket 110. According to this, the second arm 125 is moved in the counterclockwise direction along the guide hole 113 about the third hinge pin 125*b*, and the pulley unit 140 fixed to the second arm 125 is also moved in the counterclockwise direction along the guide hole 113 to extend or stretch the driving belt 220 and thus to separate the driving belt 220 from the driving shaft 210, as illustrated in FIG. 5. At this time, since the rotary cylinder 143 of the pulley unit 140 coming in contact with the driving belt 220, which is rotated in a high speed, extends the driving belt 220 while rotating in the same direction as the rotating direction of the driving belt 220, a friction force generated from contact parts between the driving belt 220 and the rotary cylinder 143 is considerably reduced.

In this case, the first arm 121 and the link 123 are operated, so that the pivot motions thereof are blocked and stopped by the first stopper 111 at a state where an angle $\alpha$ (see FIG. 2) between upper parts of the first arm 121 and the link 123, which pivot upward overcoming the elastic force of the returning spring 127, is maintained at more than 180°. That is, in the state as illustrated in FIG. 2, connecting portions of the first arm 121 and the link 123 are rotated upward (directions of arrows B and C in FIG. 2), but they can not move any further because the first stopper 111 blocks them from rotating. Also, the first arm 121 and the link 123 do not rotate in a reverse direction because the returning spring 127 pulls the link 123 in a direction of arrow D in FIG. 2. Accordingly, unless a user pushes the pedal unit 130 by her/his foot, the state as illustrated in FIG. 2 is stably maintained.

As apparent from the foregoing description, according to the exemplary embodiment of the present disclosure, the driving control apparatus of the rotary brush is operated, so that in case of stopping the rotation of the rotary brush, the pulley unit separates the driving belt from the driving shaft while rotating along with the driving belt. Accordingly, the friction force between the driving belt and the pulley unit is reduced, and thus a damage of the driving belt cannot only be prevented, but also a durability of the driving belt can be improved.

Also, the driving control apparatus of the rotary brush according to the exemplary embodiment of the present disclosure can stably maintain the state that the driving belt is separated from the driving shaft, by using the link and the stoppers. Accordingly, the driving force transmitting and blocking operation to the rotary brush can be accurately controlled.

The foregoing embodiment and advantages are merely exemplary and are not to be construed as limiting the present disclosure. The description of the present disclosure is intended to be illustrative, and not to limit the scope of the claims. Many alternatives, modifications, and variations will be apparent to those skilled in the art. In the claims, means-plus-function clauses are intended to cover the structures described herein as performing the recited function and not only structural equivalents but also equivalent structures.

What is claimed is:

1. A driving control apparatus of a rotary brush, comprising:

a fixing bracket disposed in a suction body of a vacuum cleaner;

a link unit pivotably connected to the fixing bracket;

a pedal unit connected to one side of the link unit; and a pulley unit to move in combination with the link unit and to connect or separate a driving belt to or from a driving shaft, wherein the pulley unit is rotated in the same direction as a rotating direction of the driving belt when coming in contact with the driving belt, and, wherein the link unit comprises at least three members to be foldable in at least two steps.

2. The apparatus as claimed in claim 1, wherein the pulley unit comprises:

a fixed shaft fixed to the link unit; and a rotary cylinder rotatably disposed on the fixed shaft.

3. The apparatus as claimed in claim 1, wherein the link unit comprises:

a first arm having one side pivotably connected to the fixing bracket;

a second arm having one side pivotably connected to the fixing bracket;

a link having one side connected to the first arm and the other side connected to the second arm thus to move the first and the second arms in combination with each other; and a returning spring to elastically connect the link and the fixing bracket with each other.

4. The apparatus as claimed in claim 3, wherein the pedal unit is connected with the first arm, and wherein when the pedal unit is pushed and rotated in a first direction, the first and the second arms are also rotated in the first direction to connect the driving belt to the driving shaft, and when the pedal unit is pushed and rotated in a second direction, the first and the second arms are also rotated in the second direction to separate the driving belt from the driving shaft.

5. The apparatus as claimed in claim 4, wherein the first direction is a clockwise direction and the second direction is a counterclockwise direction.

6. The apparatus as claimed in claim 3, wherein the fixing bracket comprises:

a first stopper projected to a position where an angle between upper parts of the first arm and the link is maintained to more than 180° to stop pivot motions of the first arm and the link; and a second stopper to control a pivot motion of the second arm, which is pivoted by an elastic force of the returning spring.

* * * * *